US006708452B1

(12) United States Patent
Tenute

(10) Patent No.: US 6,708,452 B1
(45) Date of Patent: Mar. 23, 2004

(54) HEATER ARRANGEMENT FOR GUTTER PROTECTOR

(76) Inventor: Steven J. Tenute, 1108 Burke Ct., Naperville, IL (US) 60563

( * ) Notice: Subject to any disclaimer, the term of this patent is extended or adjusted under 35 U.S.C. 154(b) by 0 days.

(21) Appl. No.: 10/093,726

(22) Filed: Mar. 8, 2002

(51) Int. Cl.[7] ..... E04D 13/00; H05B 1/00
(52) U.S. Cl. ..... 52/11; 52/12; 219/213
(58) Field of Search ..... 52/11, 12, 173.1; 248/48.1, 48.2, 237; 219/213

(56) References Cited

U.S. PATENT DOCUMENTS 2,111,251 A * 3/1938 Spilsbury ..... 52/94
4,081,657 A * 3/1978 Stanford ..... 219/213
4,308,696 A * 1/1982 Schroeder ..... 52/11
4,404,775 A * 9/1983 Demartini ..... 52/12
4,769,526 A * 9/1988 Taouil ..... 219/213
5,016,404 A * 5/1991 Briggs ..... 52/12
5,391,858 A * 2/1995 Tourangeau et al. ..... 219/213
5,457,916 A * 10/1995 Tenute ..... 52/12
5,878,533 A * 3/1999 Swanfeld, Jr. ..... 52/11
6,073,398 A * 6/2000 Williams ..... 52/12
6,225,600 B1 * 5/2001 Burris ..... 219/213

* cited by examiner

*Primary Examiner*—Anita King
(74) *Attorney, Agent, or Firm*—Barnes & Thornburg

(57) ABSTRACT

A heating arrangement for a gutter protector, where the gutter protector extends over at least a portion of a rain gutter. The heating arrangement includes an elongated protective cap extending along at least a portion of the gutter protector and an elongated heating element extending within the protective cap. The protective cap is formed to be attached to the gutter protector, either on top of the gutter protector or underneath the gutter protector, in either instance within a channel formed in the elongated protective cap. Depending on heating requirements, two or more of the elongated heating elements, spaced from one another, can be employed, and a further elongated heating element can be installed within the rain gutter.

20 Claims, 4 Drawing Sheets

HEATER ARRANGEMENT FOR GUTTER PROTECTOR

BACKGROUND OF THE INVENTION

This invention relates to gutter protectors, and in particular to a heating arrangement for the gutter protector to eliminate accumulation of ice and snow.

Gutter protectors have become popular for largely eliminating accumulation of leaves, twigs and other material in rain gutters. One such gutter protector is disclosed in applicant's U.S. Pat. No. 5,457,916, the disclosure of which is incorporated herein by reference.

In climates where there is a winter accumulation of ice and snow, even with a gutter protector, there can be accumulation of ice at a building eave such that ice damming occurs due to periodic freezing and thawing of the ice and snow. If the ice dam is not eliminated, the ice can work under the protective roof material, leading to roof damage and unwanted water penetration into the interior of a building.

Heat tapes and the like are often used for preventing ice damming. Heat tapes are typically strips of wire-containing material that is electrified, and heats sufficiently to dissipate any accumulating ice and snow in the vicinity of the heat tapes.

While heat tapes work well when functional, heat tapes are extremely vulnerable to damage. Since heat tapes are applied to the surface of a roof, ice and snow sliding off the roof often remove the heat tape, as well, or damage the heat tape so that it is not functional. Since the heat tape is exposed to the elements, it also has a very short life span, and must be replaced periodically, leading to aggravation and expense.

A more substantial ice melting system has been developed by Bylin Engineered Systems, of El Dorado Hills, Calif. This system, known as the RIM System, includes specially designed panels that are installed along a building eave, having a series of heating cables that provide sufficient heat to eliminate ice damming. While the RIM System is effective, it also is particularly expensive, effectively limiting its availability.

SUMMARY OF THE INVENTION

The invention comprises a heating arrangement for a gutter protector. The gutter protector comprises an elongated gutter protecting device which extends over at least a portion of a rain gutter, where the rain gutter is adapted to be mounted proximate a building eave. The heating arrangement comprises an elongated protective cap extending along at least a portion of the gutter protector, and an elongated heating element extending within the protective cap.

In accordance with the preferred form of the invention, the elongated protective cap includes a channel for accommodating the heating element. Preferably, the cap is formed to be attached to the gutter protector, and can be attached to the top side of the gutter protector or to the underside of the gutter protector.

In accordance with another form of the invention, at least two of the elongated heating elements are provided, parallel to and spaced from one another. Both heating elements extend within the protective cap. The protective cap includes a separate channel accommodating each of the heating elements.

A further elongated heating element can also be provided, extending within the rain gutter. Thus, any water entering the rain gutter after having been melted by the elongated heating elements in the protective cap will exit the gutter without freezing therewithin.

BRIEF DESCRIPTION OF THE DRAWINGS

The invention is described in greater detail in the following description of examples embodying the best mode of the invention, taking in conjunction with the drawing figures, in which.

DESCRIPTION OF EXAMPLES EMBODYING THE BEST MODE OF THE INVENTION

Figure 1:
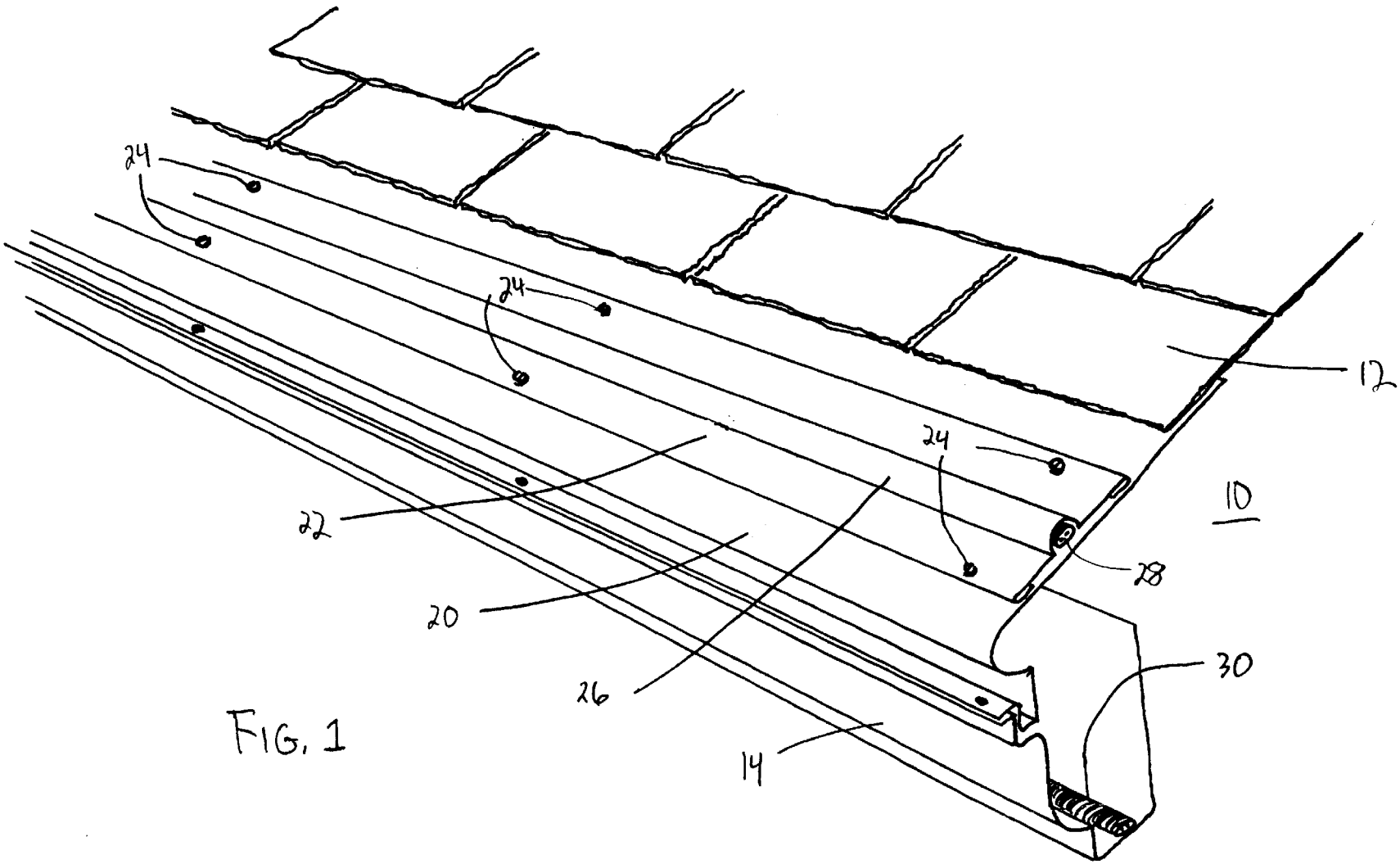
FIG. 1 is a perspective view of a heating arrangement according to the invention as installed on a gutter protector extending over a gutter installed along the building eave.
Figure 2:
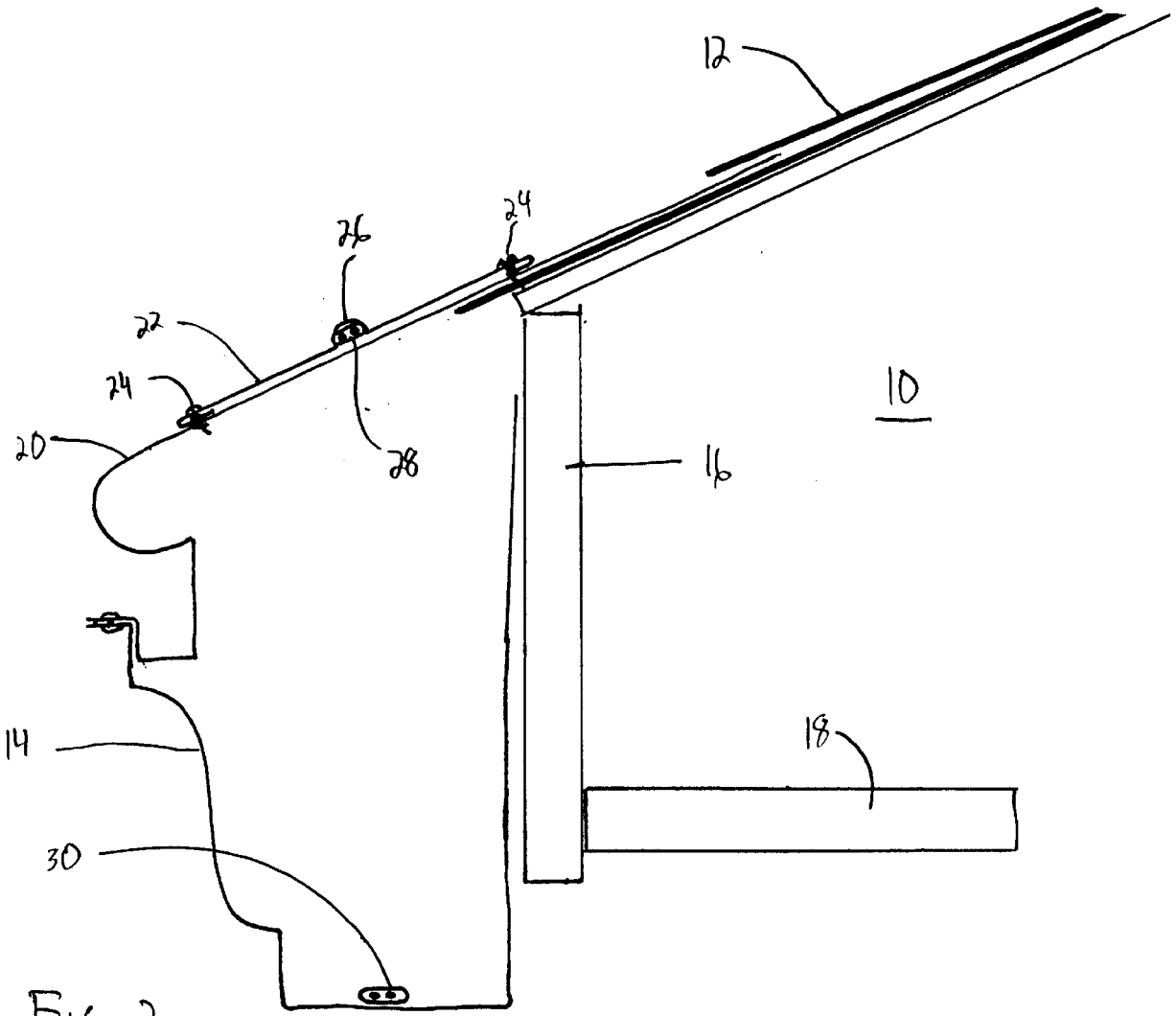
FIG. 2 is an enlarged cross-sectional view of the heating arrangement shown in FIG. 1.

FIGS. 1 and 2 illustrate one form of the invention. In a typical building 10 having a sloped roof 12, a gutter 14 is secured along the vertical building fascia 16. The fascia is offset from the building by a soffit 18. The gutter is appropriately attached to the roof or fascia in a conventional manner, and neither the gutter nor its means of attachment form any part of the present invention.

For gutter protection, as explained in greater detail in incorporated U.S. Pat. No. 5,475,916, a gutter protector including a gutter protecting device 20 is installed over the rain gutter 14. The gutter protecting device 20 permits water to flow thereover and into the gutter 14, but leaves and other debris cannot enter the gutter 14.

In the winter, ice and snow can accumulate on the roof 12, causing potential ice damming problems. To eliminate ice and snow accumulation proximate the gutter protecting device 20, a heating arrangement having an elongated protective cap 22 is secured to the gutter protecting device 20. As shown in the drawings, screws 24 are applied periodically to hold the protective cap 22 in place. Any appropriate means of holding the protective cap 22 in place can be employed, such rivets, bolts, adhesives or any other means. It is important that the protective cap 22 remain firmly in place and not be displaced by wind, debris or any other unintended means.

The protective cap 22 includes an elongated channel 26 along its length. Installed within the channel 26 is an elongated heating element 28. The heating element 28 can be a conventional heat strip, heat element or heat tape, and is therefore not shown or described in greater detail. The heating element 28 is controlled by conventional means (not illustrated) for its activation, and is typically connected to a source of electrical power (also not illustrated). The heating cable of the RIM System described above is one type of heating element that could be used.

The elongated protective cap 22 and heating element 28 comprise the heating arrangement, and since the material of the gutter protecting device 20 is typically metal which conducts heat, heat produced by the heating element 28 is conduced along the entire elongated protective cap 22 if the heating element 28 and protective cap 22 are co-extensive with the protecting device 20. Water then enters the gutter 14, and in cold climates, might freeze within the gutter 14 if sufficient heat is not conducted to the gutter, as well. To avoid that possibility, a further heating element 30 is provided in the base of the gutter 14, extending the length of the gutter. A similar heating element (not illustrated) can also be installed in any downspouts from the gutter 14 to assure that ice does not accumulate within the gutter or downspout.

Figure 3:
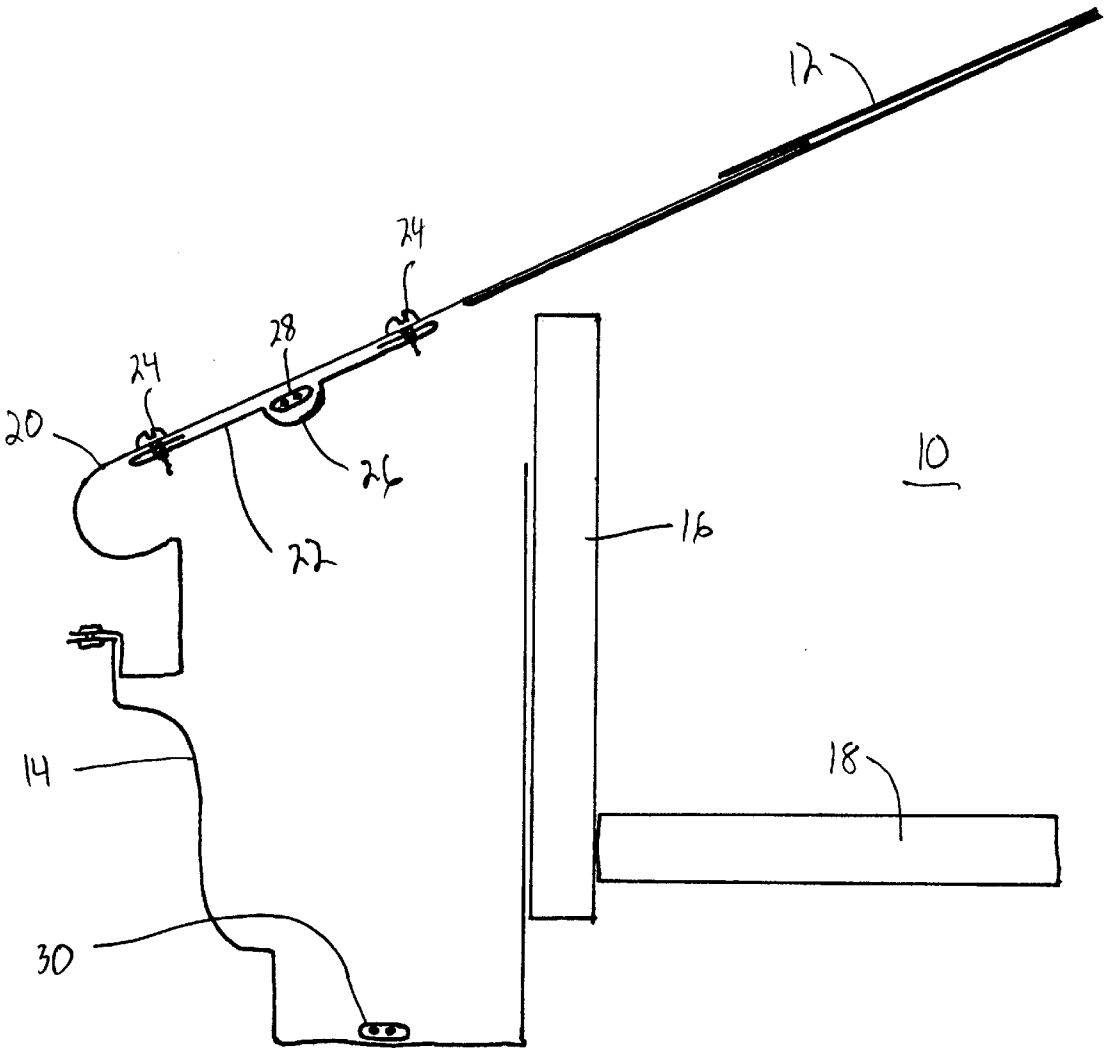
FIG. 3 is a cross-sectional view similar to FIG. 2, but with the protective cap installed on an underside of the gutter protector.

A second form of the invention is shown in FIG. 3. All elements remain identical, and therefore bear the same reference numerals. In this form of the invention, however, the elongated protective cap 22 is installed on an underside of the gutter protecting device 20, as illustrated. Thus, the protective cap 22 and the heating element 28 are protected, by the gutter protecting device 20, from the elements and any damage. Since the heating element 28 is protected under the gutter protecting device 20, the protective cap can be less robust, or can be more of a mounting support rather than a protector. It can be sectional.

Figure 4:
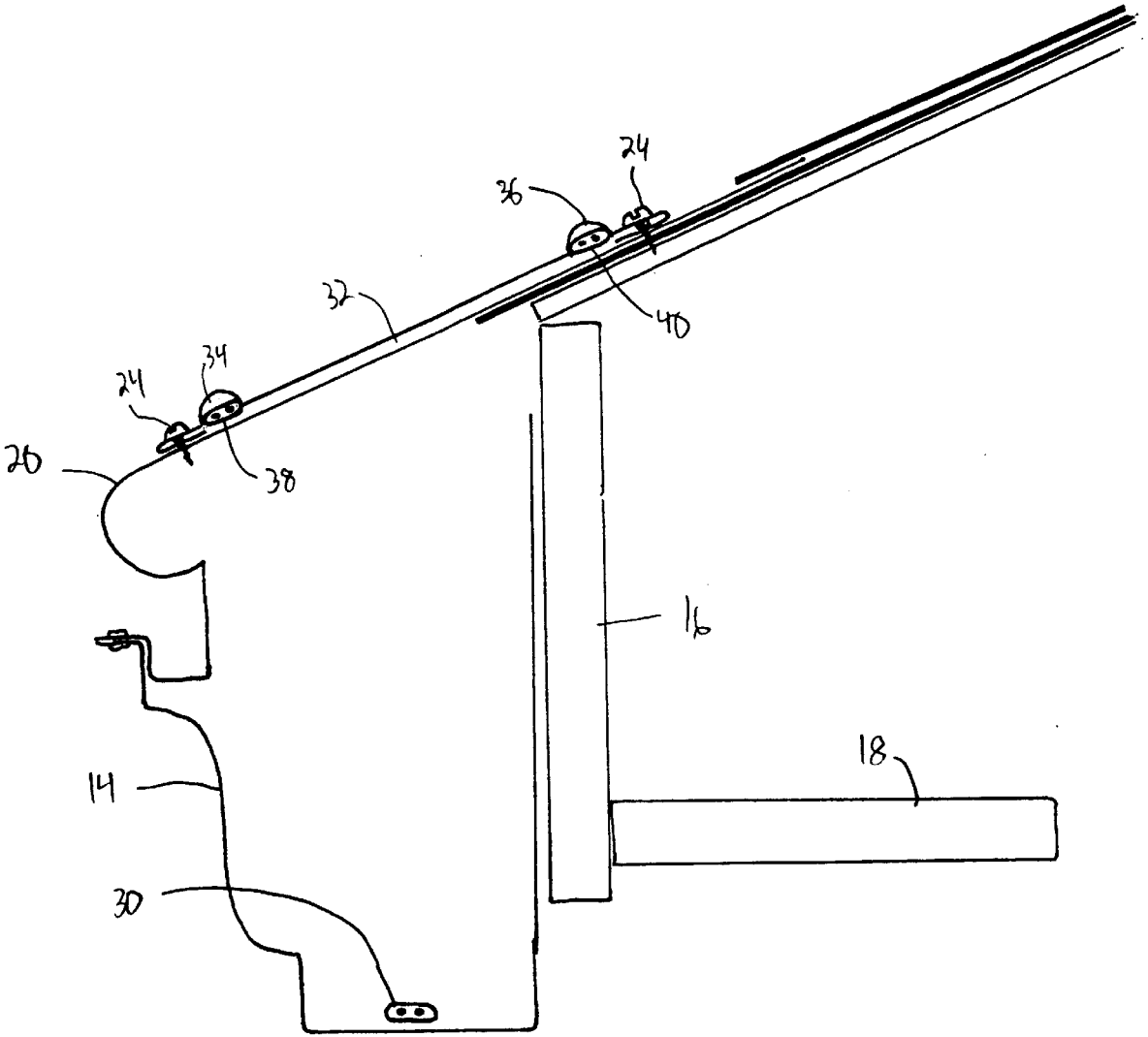
FIG. 4 is a view similar to FIG. 2, but employing a plurality of heating elements within the protective cap.

FIG. 4 illustrates a further embodiment of the invention, and again, the same elements retain the same reference numerals as identified above. In this form of the invention, an elongated protective cap 32 is provided, but instead of having a single channel, includes a pair of channels 34 and 36. Heating elements 38 and 40 are installed in the respective channels 34 and 36. This embodiment of the invention provides greater heating capacity which can be advantageous in particularly cold climates. Also, if the gutter protecting device 20 is formed of a material that is not particularly heat conductive, the form of the invention shown in FIG. 4 can be advantageous.

While the form shown in FIG. 4 includes a pair of channels 34 and 36 and the respective heating elements 38 and 40, any number of channels and heating elements can be employed, depending on the heating capacity desired and size of the elongated protective cap 32.

The invention is shown in combination with the gutter protecting device 20, which can be that of incorporated U.S. Pat. No. 5,457,916, or can be any other gutter protecting device. The invention, however, can also be used with mesh gutter protectors, or any other type of device that is applied over a gutter to protect the gutter, or in place of a gutter to perform rain channeling and drainage.

Various changes can be made to the invention without departing from the spirit thereof or scope of the following claims.

What is claimed is:

1. A heating arrangement for a gutter protector, where the gutter protector comprises an elongated gutter protecting device extending over at least a portion of a rain gutter for preventing debris from entering the gutter, the rain gutter being adapted to be mounted proximate a building eave, the heating arrangement comprising a. an elongated protective cap extending along at least a portion of the gutter protector, said protective cap being attached to said gutter protector, and b. an elongated heating element extending within said protective cap.

2. The heating arrangement according to claim 1, in which said elongated protective cap includes a channel accommodating said heating element.

3. The heating arrangement according to claim 1, in which said cap is formed to be attached to the gutter protector by fasteners.

4. The heating arrangement according to claim 3, in which said cap is formed to be attached on a top side of the gutter protector.

5. The heating arrangement according to claim 3, in which said cap is formed to be attached on an underside of the gutter protector.

6. The heating arrangement according to claim 1, including at least two of said heating elements parallel to and spaced from one another, said elongated heating elements extending within said protective cap.

7. The heating arrangement according to claim 6, in which said protective cap includes a separate channel accommodating each heating element.

8. The heating arrangement according to claim 1, including a further elongated heating element extending within the rain gutter.

9. A heated gutter arrangement, comprising a. an elongated gutter protecting device shaped to extend over at least a portion of a rain gutter for preventing debris from entering the gutter, b. an elongated protective cap extending along at least a portion of the gutter protecting device, said protective cap being attached to said gutter protector, and c. an elongated heating element extending within said protective cap between said protective cap and said gutter protector.

10. The heated gutter arrangement according to claim 9, in which said elongated protective cap includes a channel accommodating said heating element.

11. The heated gutter arrangement according to claim 9, in which said cap is formed to be attached to the gutter protector by fasteners.

12. The heated gutter arrangement according to claim 11, in which said cap is formed to be attached on a top side of the gutter protector.

13. The heated gutter arrangement according to claim 11, in which said cap is formed to be attached on an underside of the gutter protector.

14. The heated gutter arrangement according to claim 9, including at least two of said heating elements parallel to and spaced from one another, said elongated heating elements extending within said protective cap.

15. Thee heated gutter arrangement according to claim 14, in which said protective cap includes a separate channel accommodating each heating element.

16. The heated gutter arrangement according to claim 9, including a further elongated heating element extending within the rain gutter.

17. A heated gutter arrangement, comprising a. a rain gutter adapted to be mounted proximate a building eave, b. an elongated gutter protecting device shaped to extend over at least a portion of the rain gutter for preventing debris from entering the gutter, c. an elongated protective cap extending along at least a portion of the gutter protecting device, said protective cap being attached to said gutter protector, d. a first elongated heating element extending within said protective cap between said protective cap and said gutter protector, and e. a second elongated heating element extending within the rain gutter.

18. The heated gutter arrangement according to claim 17, in which said elongated protective cap includes a channel accommodating said first elongated heating element.

19. The heated gutter arrangement according to claim 17, in which said cap is formed to be attached on a top side of the gutter protector.

20. The heated gutter arrangement according to claim 17, in which said cap is formed to be attached on an underside of the gutter protector.

* * * * *